US011642718B2

(12) United States Patent
Coalmer et al.

(10) Patent No.: US 11,642,718 B2
(45) Date of Patent: May 9, 2023

(54) CABLE CLAMPING DEVICE OF A PROCESSING MACHINE

(71) Applicant: TE Connectivity Services GmbH, Schaffhausen (CH)

(72) Inventors: Jakob C. Coalmer, Middletown, PA (US); Christopher John Karrasch, Middletown, PA (US)

(73) Assignee: TE Connectivity Solutions GmbH, Schaffhausen (CH)

( * ) Notice: Subject to any disclaimer, the term of this patent is extended or adjusted under 35 U.S.C. 154(b) by 0 days.

(21) Appl. No.: 17/088,037

(22) Filed: Nov. 3, 2020

(65) Prior Publication Data

US 2021/0299734 A1 Sep. 30, 2021

Related U.S. Application Data

(60) Provisional application No. 63/001,787, filed on Mar. 30, 2020.

(51) Int. Cl.
*H01R 43/048* (2006.01)
*B21D 43/28* (2006.01)

(52) U.S. Cl.
CPC ..... *B21D 43/287* (2013.01); *H01R 43/048* (2013.01); *Y10T 29/53213* (2015.01)

(58) Field of Classification Search
CPC .. H01R 43/042; H01R 9/0518; H01R 43/048; H01R 4/023; Y10T 29/53213; Y10T 29/53257; Y10T 29/49174; Y10T 29/53226; Y10T 29/53235; Y10T 29/5151; Y10T 29/5327; Y10T 29/53283
USPC ..... 29/748, 518, 747, 751, 753, 758, 857, 29/861, 863
See application file for complete search history.

(56) References Cited

U.S. PATENT DOCUMENTS 11,233,368 B2 * 1/2022 Kerstetter ..... H01R 43/042
2019/0103718 A1 4/2019 Kerstetter et al.

OTHER PUBLICATIONS

International Search Report, International Application No. PCT/IB2021/052652, dated Mar. 30, 2021.

* cited by examiner

*Primary Examiner* — Thiem D Phan

(57) ABSTRACT

A cable clamping device includes a pair of grip jaws, a reset mechanism, and a handle connected to the grip jaws by the reset mechanism. The handle is pivotable about a handle pivot between a first position in which the grip jaws are in an open position and a second position in which the grip jaws are in a closed position around a cable. The reset mechanism pivots the handle from the second position to the first position before moving to a reset position of the reset mechanism that holds the handle in the first position.

19 Claims, 7 Drawing Sheets

CABLE CLAMPING DEVICE OF A PROCESSING MACHINE

CROSS-REFERENCE TO RELATED APPLICATION

This application claims priority under 35 U.S.C. § 119 to U.S. Provisional Patent Application No. 63/001,787, filed on Mar. 30, 2020.

FIELD OF THE INVENTION

The present invention relates to a processing machine for a cable and, more particularly, to a cable clamping device of the processing machine.

BACKGROUND

In a processing machine, such as a wire terminator, a cable clamping device holds a cable while the cable is processed. The cable clamping device includes a handle that is pivotable between an open state releasing the cable and a closed state gripping the cable. The pivoting motion of the handle acts through a mechanism to close or open the clamping device around the cable. The mechanism is also capable of being actuated to apply a force to the handle that pivots the handle.

When the handle is moved by the mechanism from a position gripping the cable to release the cable, the handle is held by a linkage of the mechanism and does not fully return to the open state. If the mechanism is then actuated to apply a force intending to hold the handle in the open state, to secure the handle for further cycles of the processing machine, the handle could instead unintentionally pivot back to the closed state. The cable clamping device cannot reliably secure the handle in the open state, impairing the efficiency of operating the cable clamping device and the processing machine.

SUMMARY

A cable clamping device includes a pair of grip jaws, a reset mechanism, and a handle connected to the grip jaws by the reset mechanism. The handle is pivotable about a handle pivot between a first position in which the grip jaws are in an open position and a second position in which the grip jaws are in a closed position around a cable. The reset mechanism pivots the handle from the second position to the first position before moving to a reset position of the reset mechanism that holds the handle in the first position.

BRIEF DESCRIPTION OF THE DRAWINGS

The invention will now be described by way of example with reference to the accompanying Figures, of which.

DETAILED DESCRIPTION OF THE EMBODIMENTS

Figure 1:
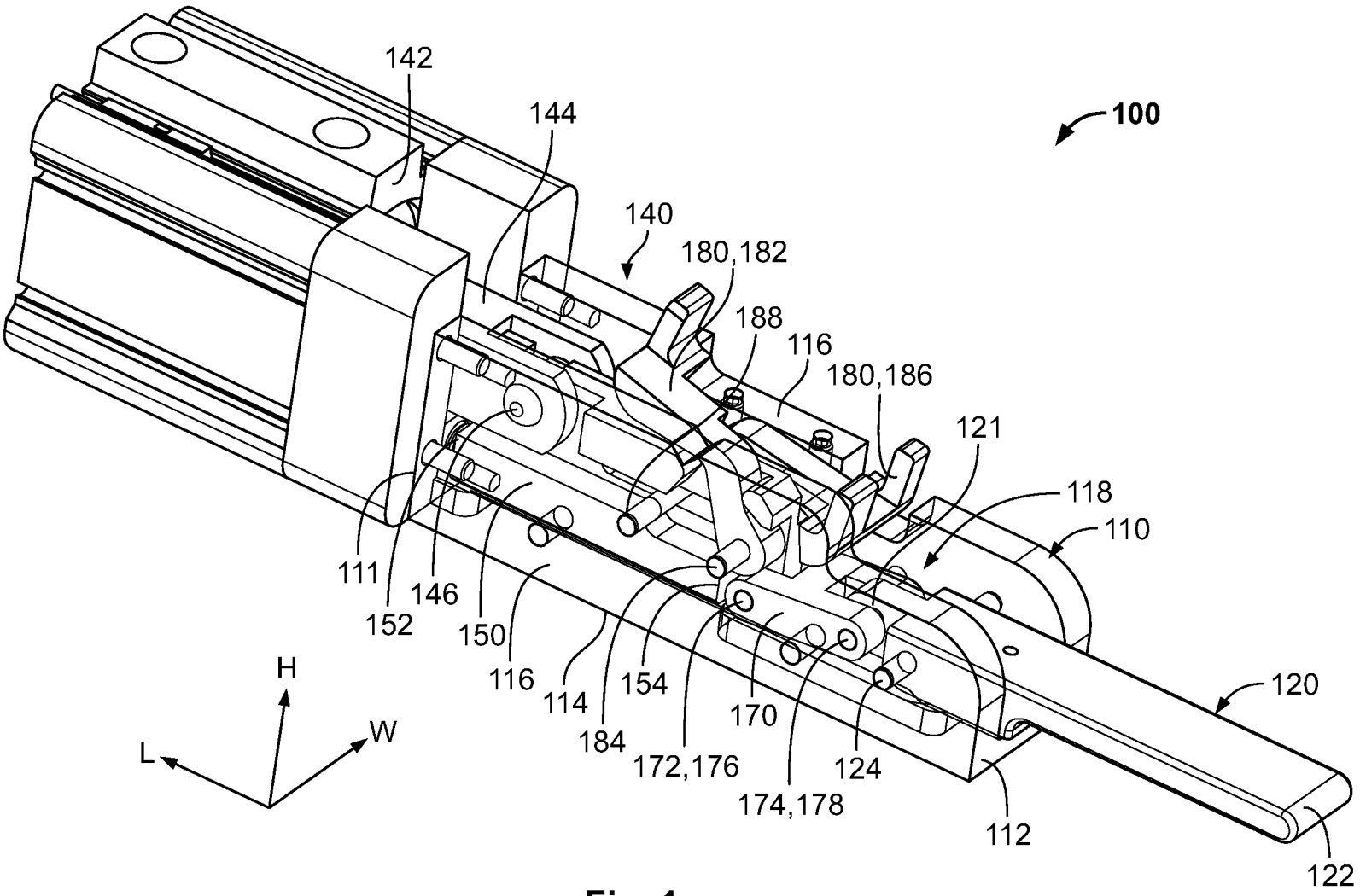
FIG. 1 is a top perspective view of a cable clamping device.

Exemplary embodiments of the present disclosure will be described hereinafter in detail with reference to the attached drawings, wherein like reference numerals refer to like elements. The present disclosure may, however, be embodied in many different forms and should not be construed as being limited to the embodiments set forth herein; rather, these embodiments are provided so that the present disclosure will convey the concept of the disclosure to those skilled in the art. In addition, in the following detailed description, for purposes of explanation, numerous specific details are set forth in order to provide a thorough understanding of the disclosed embodiments. However, it is apparent that one or more embodiments may also be implemented without these specific details.

Figure 2:
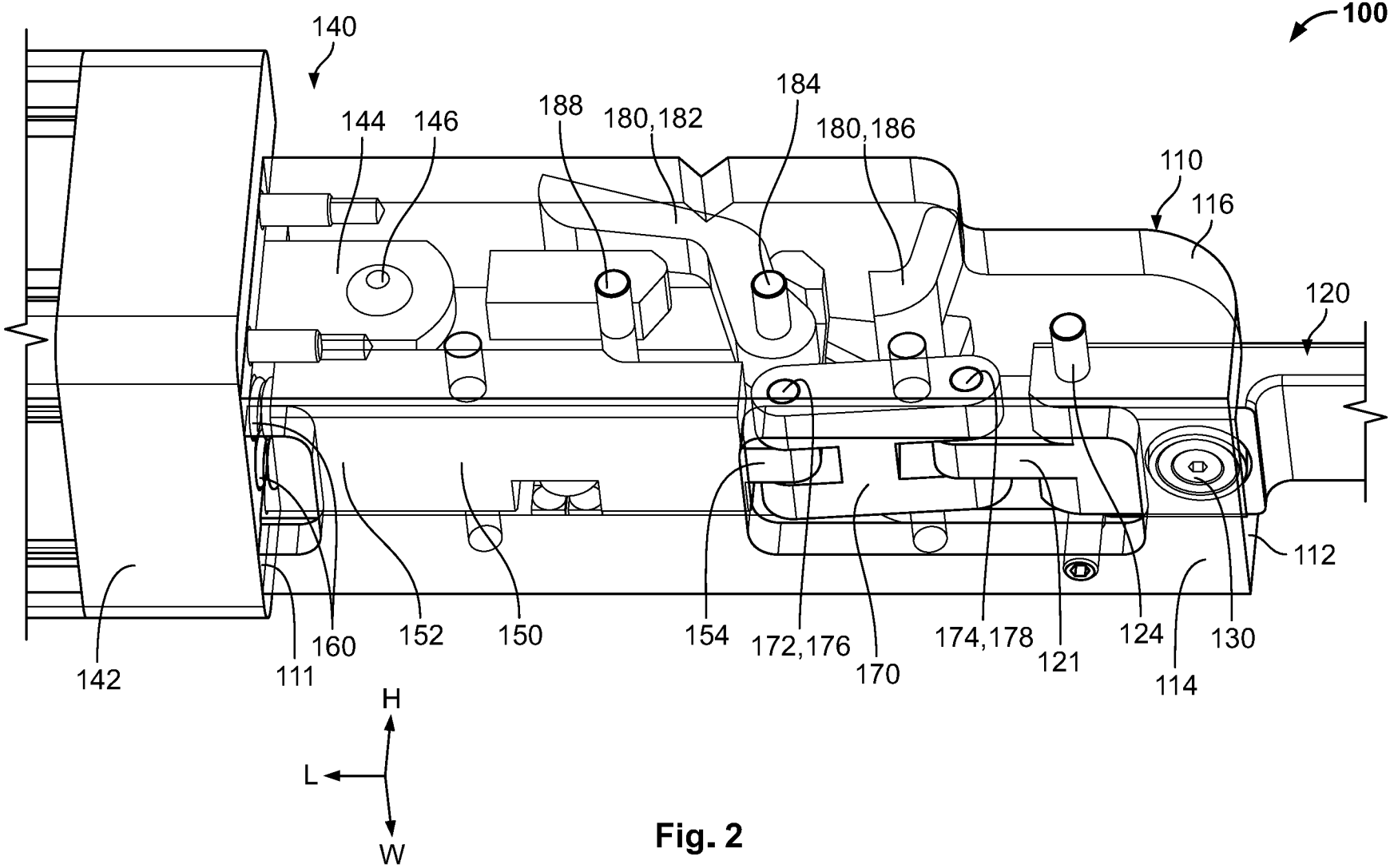
FIG. 2 is a bottom perspective view of a portion of the cable clamping device.

A cable clamping device 100 according to an embodiment is shown in FIGS. 1 and 2. The cable clamping device 100 comprises a housing 110, a handle 120 pivotally attached to the housing 110, a handle retaining device 130, a reset mechanism 140 connected to the handle 120, and a pair of grip jaws 180 pivotally connected to the housing 110 and moved by the reset mechanism 140.

The housing 110, as shown in FIGS. 1 and 2, extends from a first end 111 to a second end 112 along the longitudinal direction L. The housing 110 has a bottom wall 114 and a pair of side walls 116 extending from the bottom wall 114 in a height direction H perpendicular to the longitudinal direction L. The side walls 116 extend parallel to one another along the longitudinal direction L and are spaced apart from one another in a width direction W perpendicular to both the longitudinal direction L and the height direction H. The bottom wall 114 and the side walls 116 define a receiving space 118 between them.

Figure 4:
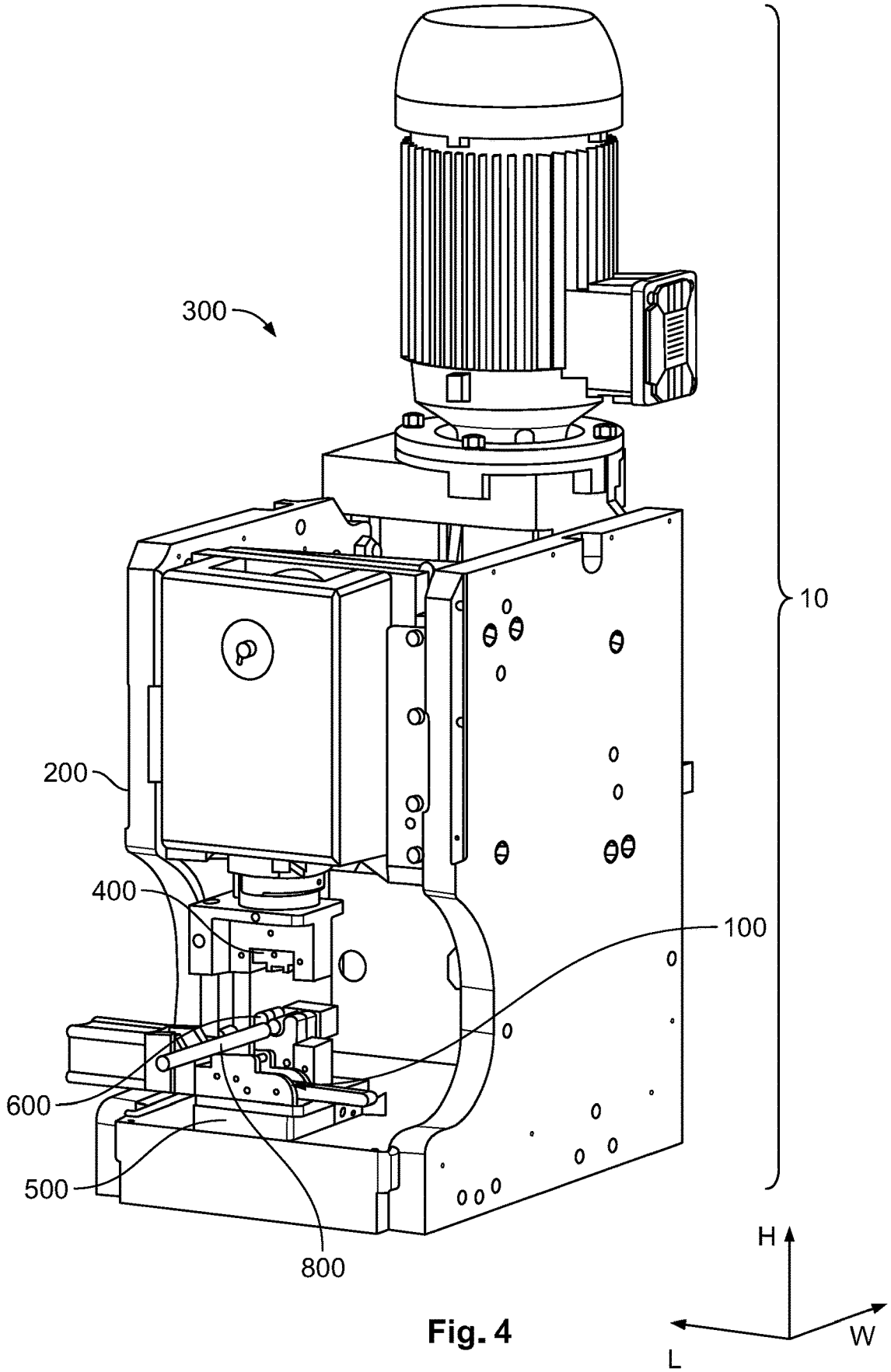
FIG. 4 is a perspective view of a processing machine according to an embodiment.
Figure 5:
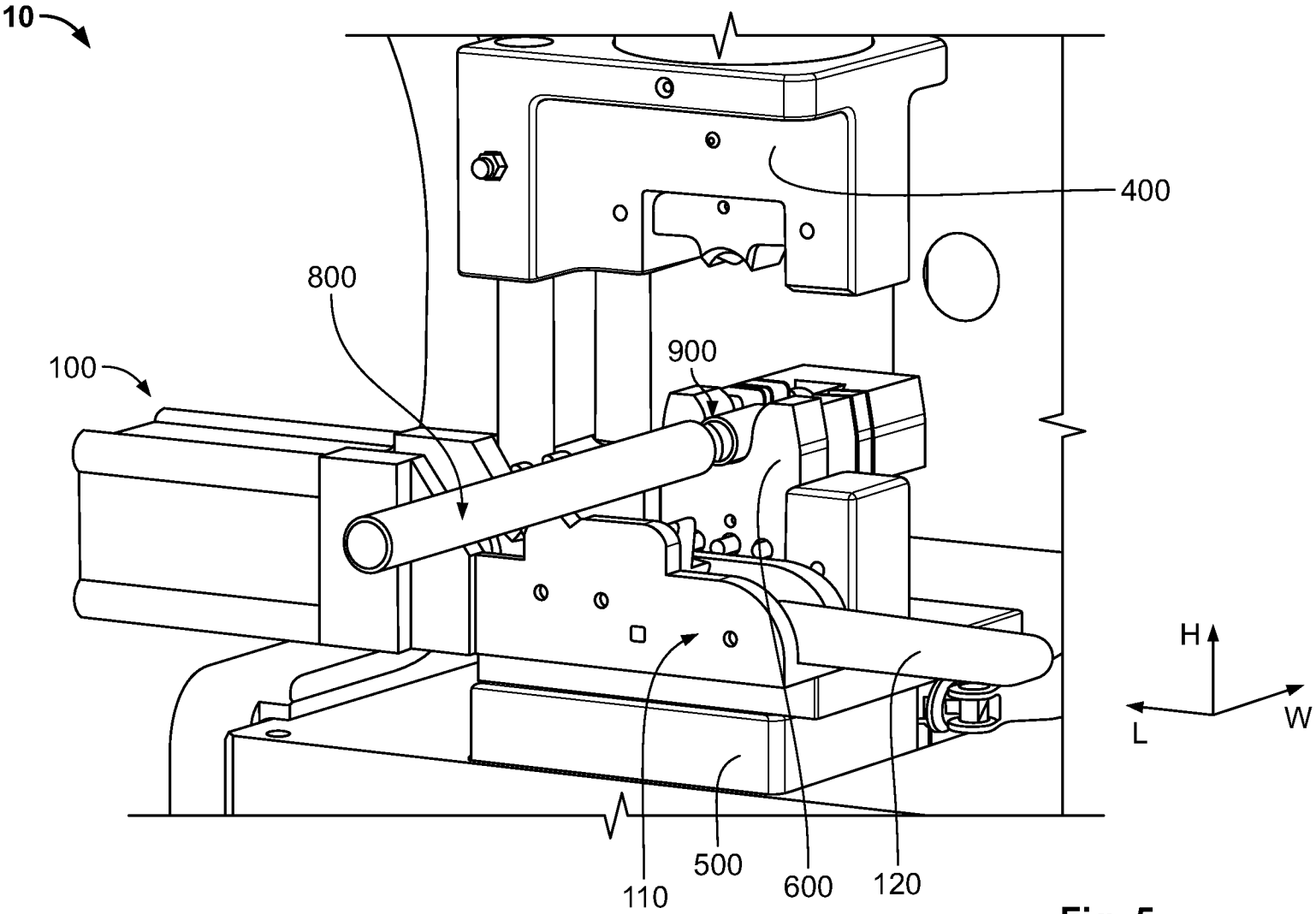
FIG. 5 is a detail perspective view of a portion of the processing machine.

The housing 110 is shown transparent in FIGS. 1 and 2 for ease of understanding in depicting and describing the positioning of other elements within the receiving space 118. The transparent appearance, however, is not intended to represent or limit any quality of the housing 110, which is a solid member of the cable clamping device 100 as shown in FIGS. 4 and 5

Figure 3A:
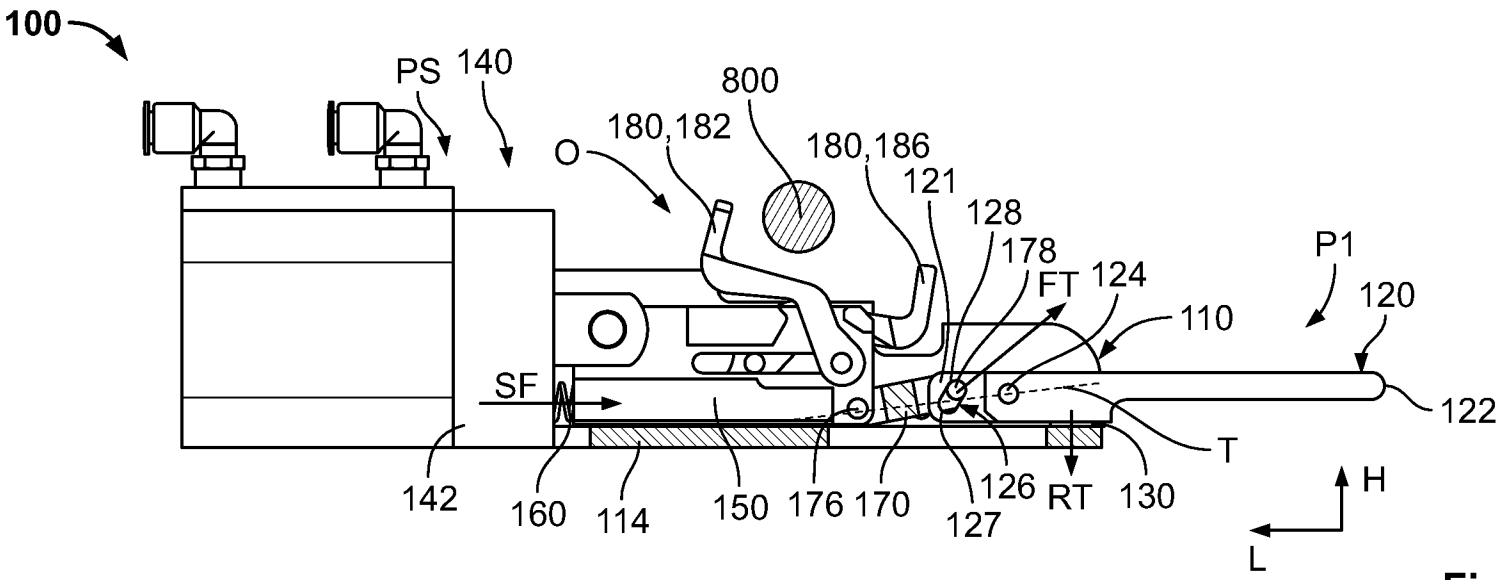
FIG. 3A is a sectional side view of the cable clamping device in a first step of clamping a cable.

The handle 120, as shown in FIGS. 1 and 2, extends from a first end 121 to a second end 122 along the longitudinal direction L. The handle 120 has a handle pivot 124 between the first end 121 and the second end 122. At the first end 121, as shown in FIG. 3A, the handle 120 has an angled slot 126 extending through the handle 120. The angled slot 126 has a lower end 127 and an upper end 128 opposite the lower end 127. In the shown embodiment, the angled slot 126 extends linearly and diagonally from the lower end 127 to the upper end 128 in a plane defined by the height direction H and the longitudinal direction L. In other embodiments, the angled slot 126 could extend in a curved manner from the lower end 127 to the upper end 128 in the plane defined by the height direction H and the longitudinal direction L.

The handle 120, as shown in FIG. 1, is positioned in the receiving space 118 and connected to the side walls 116 of the housing 110 by the handle pivot 124. The second end 122 of the handle 120 protrudes from the second end 112 of the housing 110. The handle 120 is pivotable with respect to the housing 110 about the handle pivot 124

The handle retaining device 130, as shown in FIG. 2, is positioned in the receiving space 118 between the handle 120 and the housing 110. The handle retaining device 130 may be attached to housing 110 or may be attached to the handle 120. In another embodiments, the handle retaining device 130 may have multiple components and may be attached to both the housing 110 and the handle 120. In an embodiment, the handle retaining device 130 is a magnet capable of attracting the handle 120 toward the housing 110. In other embodiments, the handle retaining device 130 may be a ball detent, a frictional element, a spring mechanism, or any other type of device that can provide a force retaining the handle 120 against the housing 110 in the position shown in FIGS. 1 and 2.

The reset mechanism 140, as shown in FIGS. 1 and 2, includes an actuating device 142, a slide 150 connected to the actuating device 142, a plurality of springs 160 disposed between the actuating device 142 and the slide 150, and a link 170 connecting the slide 150 to the handle 120.

The actuating device 142, as shown in FIGS. 1 and 2, is attached to the first end 111 of the housing 110 and has a clevis 144 extending in the longitudinal direction L into the receiving space 118. The clevis 144 has a clevis pin 146 disposed at an end of the clevis 144 in the longitudinal direction L. The actuating device 142 in the shown embodiment is an air cylinder capable of moving the clevis 144 along the longitudinal direction L. In other embodiments, the actuating device 142 may be any motive power device capable of moving the clevis 144 along the longitudinal direction L.

The slide 150, as shown in FIGS. 1 and 2, is positioned in the receiving space 118 and extends along the longitudinal direction L from a first end 152 to a second end 154. The first end 152 is connected to the clevis pin 146.

The plurality of springs 160, as shown in FIG. 2, are positioned in the receiving space 118 between the actuating device 142 and the first end 152 of the slide 150 in the longitudinal direction L. Two springs 160 are positioned between the actuating device 142 and the slide 150 in the shown embodiment. In other embodiments, only one spring 160 or more than two springs 160 may be positioned between the actuating device 142 and the slide 150. In the shown embodiment, each of the springs 160 is a coil spring. In other embodiments, each of the springs 160 may be any other type of spring providing an outward elastic spring force when compressed.

The link 170, as shown in FIGS. 1 and 2, is positioned in the receiving space 118 and extends from a first end 172 to a second end 174. The first end 172 has a link pivot 176 connected to the second end 154 of the slide 150. The link 170 is pivotable with respect to the slide 150 about the link pivot 176. The second end 174 has a drive pin 178 extending through the angled slot 126 of the handle 120, as shown in FIG. 3A. The link 170 is pivotable with respect to the handle 120 about the drive pin 178.

The grip jaws 180, as shown in FIGS. 1 and 2, include a first grip jaw 182 and a second grip jaw 186 disposed in and extending out from the receiving space 118. The first grip jaw 182 has a first jaw pivot 184 connected to the housing 110. The first grip jaw 182 is pivotable with respect to the housing 110 about the first jaw pivot 184. The second grip jaw 186 has a second jaw pivot 188 connected to the housing 110 between the actuating device 140 and the first jaw pivot 184 along the longitudinal direction L. The second grip jaw 186 is pivotable with respect to the housing 110 about the second jaw pivot 188.

The clamping of a cable 800 with the cable clamping device 100 will now be described in greater detail primarily with reference to FIGS. 3A-3E. In FIGS. 3A-3E, reference numbers for some elements of the cable clamping device 100 shown in FIGS. 1 and 2 may be omitted for clarity of the drawings, but the elements shown in FIGS. 3A-3E are the same as those shown and described above with respect to FIGS. 1 and 2.

In FIG. 3A, the handle 120 is shown in a first position P1 in which the handle 120 extends along the longitudinal direction L and abuts the housing 110. The handle retaining device 130 applies a retaining force RT in the first position P1 acting to retain the handle 120 in the first position P1. In the first position P1 of the handle 120, the grip jaws 180 are in an open position O in which the grip jaws 180 are spaced apart from the cable 800.

The reset mechanism 140 is shown in a reset position PS in FIG. 3A. In the reset position PS, the springs 160 are compressed between the actuating device 142 and the slide 150 and apply a spring force SF urging the slide 150 toward the handle 120 in the longitudinal direction L. The actuating device 142 does not apply a force to the slide 150 in the reset position PS. With the handle 120 in the first position P1, the urging of the slide 150 toward the handle 120 moves the drive pin 178 of the link 170 along the angled slot 126 and into abutment with the upper end 128, pivoting the link 170 about the link pivot 176 with respect to the slide 150. The spring force SF is transferred through the slide 150 and the link 170 to the drive pin 178 abutting the upper end 128 of the angled slot 126, applying a toggle force FT to the handle 120 at the angled slot 126.

As shown in FIG. 3A, a toggle axis T extends through a center of the link pivot 176 and a center of the handle pivot 124. When the drive pin 178 is positioned in the angled slot 126 above the toggle axis T in the height direction H, as shown in FIG. 3A, the toggle force FT applied to the handle 120 urges the handle 120 to pivot about the handle pivot 124 toward the first position P1. With the reset mechanism 140 in the reset position PS and the handle 120 in the first position P1 as shown in FIG. 3A, the toggle force FT acts to hold the handle 120 in the first position P1.

Figure 3B:
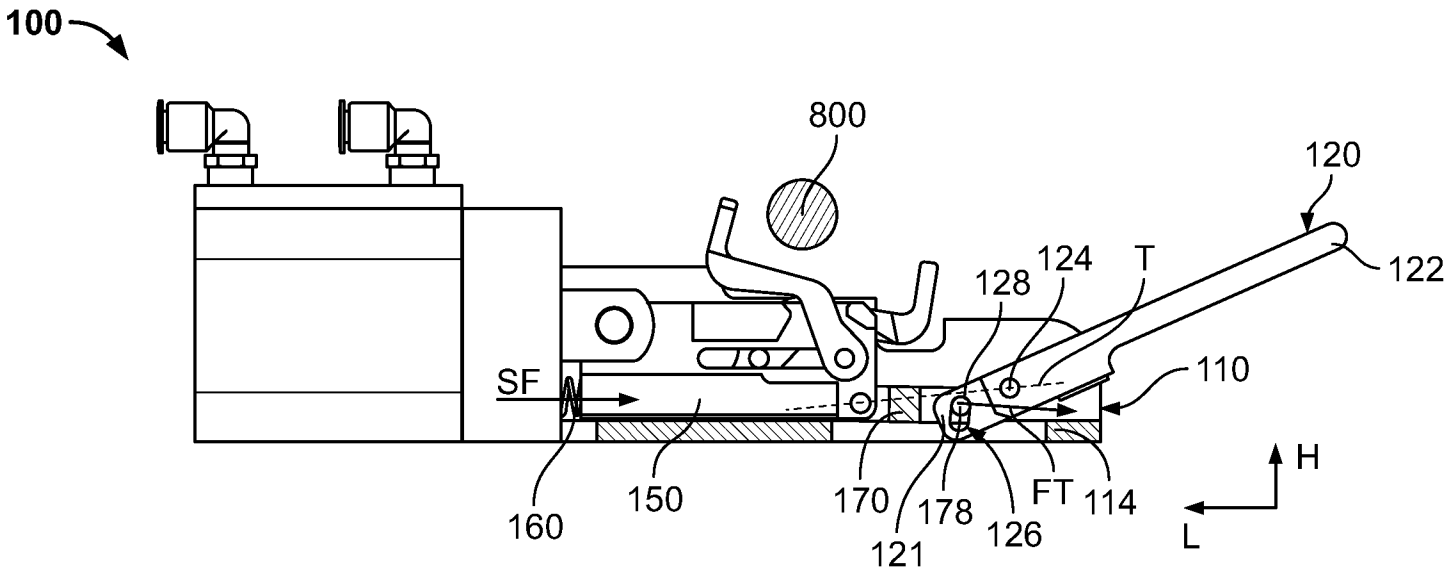
FIG. 3B is a sectional side view of the cable clamping device in a second step of clamping the cable.

In order to clamp the cable 800, a user rotates the second end 122 of the handle 120 about the handle pivot 124 away from the bottom wall 114 and out of the first position P1, as shown in FIG. 3B. The user needs to apply a force to pivot the handle 120 that is sufficient to overcome the retaining force RT and the toggle force FT acting to maintain the handle 120 in the first position P1.

As the handle 120 pivots out of the first position P1, the link 170 is pivoted with respect to the first end 121 of the handle 120 while the drive pin 178 remains in abutment with the upper end 128 of the angled slot 126. As shown in FIG. 3B, while still applying the toggle force FT through the spring force SF transferred through the slide 150 and the link 170, the drive pin 178 moves below the toggle axis T in the height direction H. The toggle force FT applied below the toggle axis T urges the handle 120 further away from the first position P1 shown in FIG. 3A and toward a second position P2 of the handle 120 shown in FIG. 3C. With the toggle axis T between the first position P1 and the second position P2, the toggle force FT urges the handle 120 toward the first position P1 above the toggle axis T and urges the handle 120 toward the second position P2 below the toggle axis T.

With the drive pin 178 below the toggle axis T, the spring force SF moves the slider 150 away from the actuating device 142 along the longitudinal direction L to an extended position PE of the slider 150 shown in FIG. 3C. The clevis 144 attaching the actuating device 142 to the slider 150 moves with the slider 150 along the longitudinal direction L. The toggle force FT continues to pivot the link 170 with respect to the first end 121 until the handle 120 reaches the second position P2. As the handle 120 moves into the second position P2, the drive pin 178 slides along the angled slot 126 from the upper end 128 into abutment with the lower end 127.

Figure 3C:
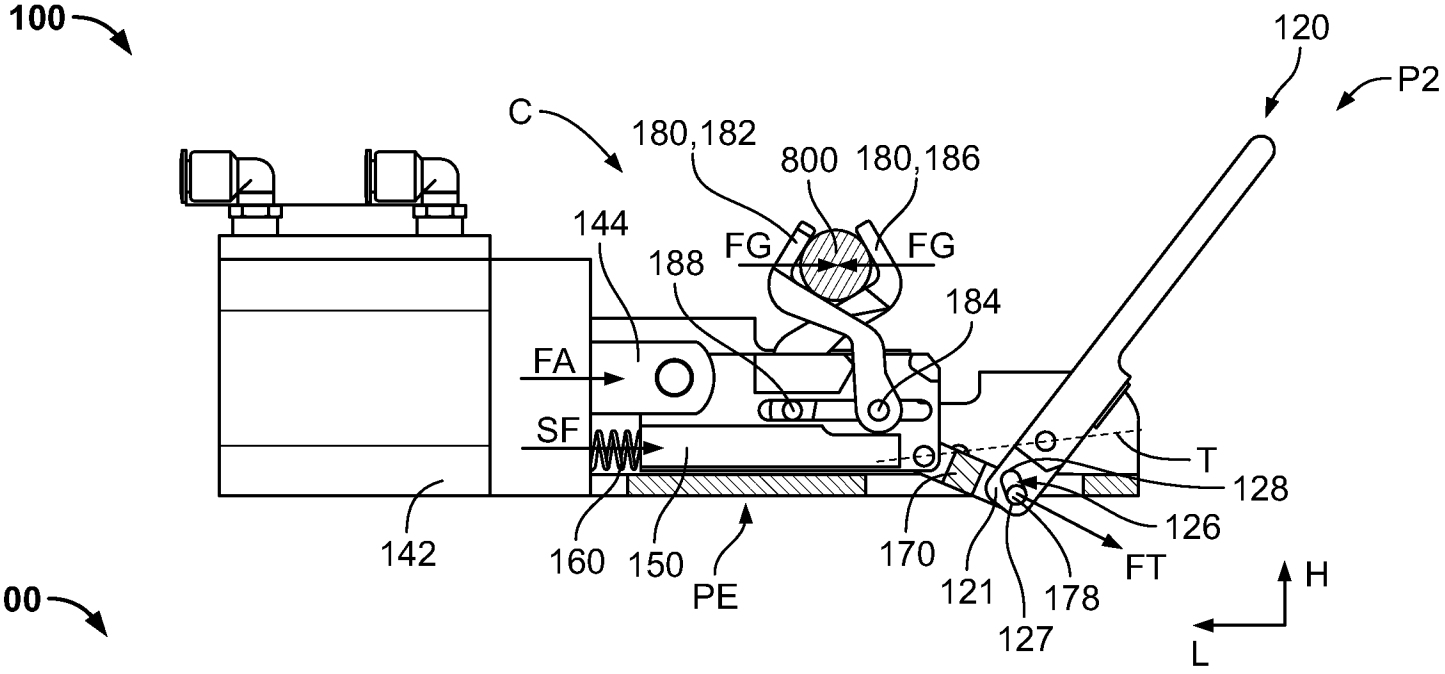
FIG. 3C is a sectional side view of the cable clamping device in a third step of clamping the cable.

As the slider 150 moves to the extended position PE, the slider 150 contacts the grip jaws 180 and the movement of the slider 150 pivots the grip jaws 180 about the jaw pivots 184, 188 from the open position O shown in FIG. 3A to the closed position C shown in FIG. 3C. In the closed position C, the grip jaws 180 abut the cable 800, with the first grip jaw 182 disposed on a first side of the cable 800 and the second grip jaw 186 disposed on an opposite second side of the cable 800. The spring force SF moving the slider 150 into the extended position PE moves the grip jaws 180 into a first state of the closed position C in which the grip jaws 180 grip the cable 800 with a gripping force FG provided by the spring force SF. The grip jaws 180 are in the closed position C when the handle 120 is in the second position P2.

From the first state of the closed position C of the grip jaws 180, the actuating device 142 can, in an embodiment, apply an actuating force FA through the clevis 144 urging the slide 150 in the extended position PE further away from the actuating device 142 along the longitudinal direction L. The actuating force FA on the slider 150 urges the grip jaws 180 about the jaw pivots 184, 188 into further engagement with the cable 800, transferring the grip jaws 180 into a second state of the closed position C in which the grip jaws 180 grip the cable 800 with a greater gripping force FG provided by both the spring force SF and the actuating force FA of the actuating device 142. The grip jaws 180 apply a tighter gripping force FG on the cable 800 in the second state than in the first state.

Figure 3D:
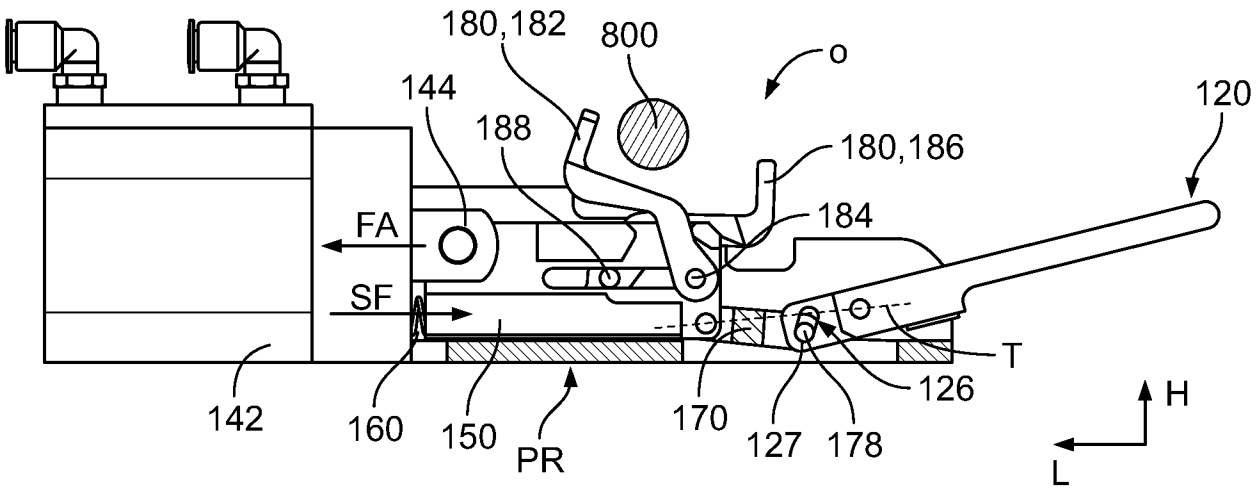
FIG. 3D is a sectional side view of the cable clamping device in a fourth step of clamping the cable.

When the cable 800 no longer needs to be clamped by the clamping device 100 through the gripping of the grip jaws 180, the actuating device 142 applies the actuating force FA through the clevis 144 in an opposite direction to that shown in FIG. 3C to move the slide 150 toward the actuating device 142 along the longitudinal direction L, as shown in FIG. 3D. The actuating device 142 moves the slide 150 from the extended position PE distal from the actuating device 142 to a retracted position PR proximal to the actuating device 142, compressing the springs 160. The actuating force FA moving the slide 150 to the retracted position PR acts against the spring force SF and is greater than the spring force SF. The toggle force FT is not applied in the state shown in FIG. 3D because the actuating force FA overcomes the spring force SF.

The movement of the slide 150 to the retracted position PR pivots the grip jaws 180 about the jaw pivots 184, 188 out of the closed position C and to the open position O as shown in FIG. 3D, releasing the cable 800 from the gripping force FG. The movement of the slide 150 also pivots the link 170 with respect to the handle 120. The drive pin 178 remains in abutment with the lower end 127 of the angled slot 126, pivoting the handle 120 about the handle pivot 124 back toward the first position P1. The drive pin 178 is still below the toggle axis T in the state shown in FIG. 3D; if the actuating force FA were removed and the spring force SF were the only force applied to the slide 150 in this state, the handle 120 would pivot back to the second position P2 under the toggle force FT.

Figure 3E:
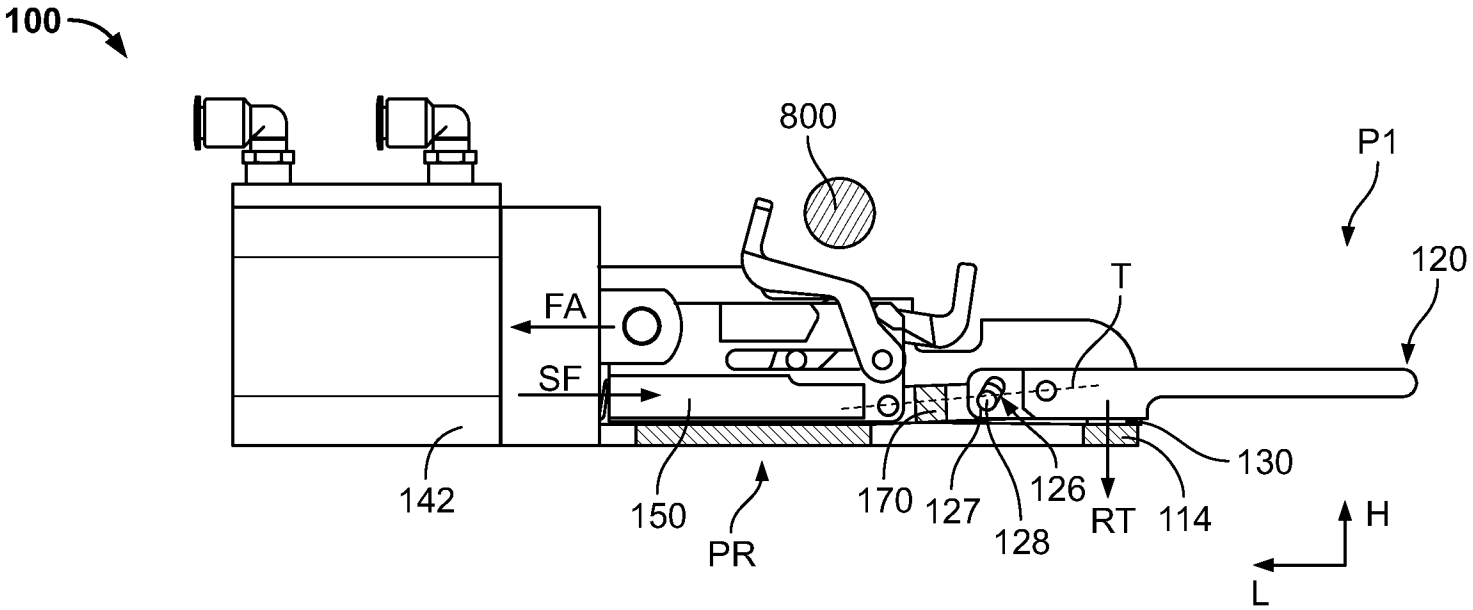
FIG. 3E is a sectional side view of the cable clamping device in a fifth step of clamping the cable.

The actuating device 142 continues to apply the actuating force FA until the handle 120 reaches the first position P1 in abutment with the bottom wall 114, as shown in FIG. 3E. The handle retaining device 130 applies a retaining force RT in the first position P1 acting to retain the handle 120 in the first position P1. The drive pin 178 remains in abutment with the lower end 127 of the angled slot 126 when the handle 120 reaches the first position P1 and the slide 150 remains held in the retracted position PR against the spring force SF.

The actuating force FA is released from the position shown in FIG. 3E when the actuating device 142 is deactivated. The spring force SF then moves the slide 150 away from the actuating device 142; the spring force SF moves the slide 150 out of the retracted position PR and toward the extended position PE. The spring force SF acts on the link 170 through movement of the slide 150, moving the drive pin 178 from the lower end 127 of the angled slot 126 below the toggle axis T to the upper end 128 of the angled slot 126 above the toggle axis T as shown in the reset position PS in FIG. 3A. The spring force SF applies the toggle force FT as shown in FIG. 3A, holding the handle 120 in the first position P1.

The user can use the cable clamping device 100 to clamp and release the cable 800, resetting the handle 120 to the first position P1 as shown in FIGS. 3A-3E. The reset mechanism 140, as shown in FIGS. 3C-3E, pivots the handle 120 from the second position P2 to the first position P1 before moving to the reset position PS shown in FIG. 3A that holds the handle 120 in the first position P1. As the handle 120 moves from the second position P2 back to the first position P1, the toggle force FT acting on the handle 120 is not applied until the handle 120 has fully reached the first position P1. The cable clamping device 100 according to the present invention thus ensures the action of the toggle force FT on the handle 120 when it is initially applied, avoiding an unexpected rotation of the handle 120 back to the second position P2 under the toggle force FT.

A processing machine 10 according to an embodiment, as shown in FIGS. 4 and 5, comprises a frame 200, a drive 300 movable with respect to the frame 200 along the height direction H, an upper tooling 400 attached to the drive 300, a base plate 500 attached to the frame 200, and a lower tooling 600 attached to the base plate 500. The drive 300 moves the upper tooling 400 toward and away from the lower tooling 600 along the height direction H. The drive 300, in an embodiment, includes a motor, a gearbox, and a connection to translate motion. In other embodiments, the drive 300 may be any type of drive capable of moving the upper tooling 400 with respect to the lower tooling 600.

As shown in FIGS. 4 and 5, the processing machine 10 includes the cable clamping device 100 attached to the base plate 500. The cable clamping device 100 clamps and releases the cable 800 as described with respect to FIGS. 3A-3E above, and an end of the cable 800 is disposed in a terminal 900 that is held in the lower tooling 600.

The cable 800 is positioned in the terminal 900 with the grip jaws 180 in the open position O, the handle 120 in the first position P1, and the reset mechanism 140 in the reset position PS, as shown in FIG. 3A. The user then closes the grip jaws 180 around the cable 800 to apply the gripping force FG to the cable 800 as shown and described above with respect to FIGS. 3A-3C.

The cable clamping device 100 clamps the cable 800, as shown and described with respect to FIG. 3C, to position the cable 800 while the drive 300 moves the upper tooling 400 with respect to the lower tooling 600. The upper tooling 400 moves toward and abuts the lower tooling 600 to crimp the terminal 900 onto the cable 800 with the grip jaws 180 in the first state of the closed position C. The lighter gripping force FG applied by the grip jaws 180 in the first state of the closed position C allows the cable 800 to slide or expand in the grip jaws 180 along the width direction W while the terminal 900 and cable 800 undergo extrusion during crimping.

The drive 300 moves the upper tooling 300 away from the lower tooling 600 when crimping is completed, as shown in FIGS. 4 and 5. If the crimp was properly formed, the user releases the cable 800 crimped to the terminal 900 from the cable clamping device 100 as shown in FIGS. 3C-3E and described above.

In an embodiment, if a defective crimp is detected, the actuating device 142 applies the actuating force FA to urge the grip jaws 180 into the second state of the closed position C, applying a tighter gripping force FG on the cable 800 that prevents the user from removing the cable 800 from the processing machine 10. In this embodiment, the cable 800 can only be removed from the processing machine 10 and the cable clamping device 100 as shown in FIGS. 3C-3E and described above after an additional action, such as a entering a code at the processing machine 10 or swiping a badge at the processing machine 10.

In the embodiment shown in FIGS. 4 and 5, the processing machine 10 is a wire terminator for crimping the terminal 900 onto the cable 800. In other embodiments, the processing machine 10 may be any type of machine that processes a cable 800 and requires the cable clamping device 700 to hold the cable 800 during processing.

What is claimed is:

1. A cable clamping device, comprising:

a pair of grip jaws;

a reset mechanism; and a handle connected to the grip jaws by the reset mechanism, the handle is pivotable about a handle pivot between a first position in which the grip jaws are in an open position and a second position in which the grip jaws are in a closed position around a cable, the reset mechanism pivots the handle from the second position to the first position before moving to a reset position of the reset mechanism that holds the handle in the first position, the handle has an angled slot at an end of the handle, the reset mechanism is connected to the handle at the angled slot.

2. The cable clamping device of claim 1, wherein the reset mechanism includes a slide and a link connecting the slide to the handle.

3. The cable clamping device of claim 2, wherein the link has a first end pivotably connected to the slide at a link pivot and a drive pin at a second end opposite the first end, the drive pin is disposed in and movable between an upper end and a lower end of the angled slot.

4. The cable clamping device of claim 3, wherein the handle has a toggle axis between the first position and the second position, the reset mechanism applies a toggle force to the handle, the handle is urged under the toggle force toward the first position when the drive pin is above the toggle axis and toward the second position when the drive pin is below the toggle axis.

5. The cable clamping device of claim 4, wherein the reset mechanism applies the toggle force after the handle is in the first position.

6. The cable clamping device of claim 4, wherein the reset mechanism includes an actuating device connected to the slide and moving the slide between a retracted position and an extended position.

7. The cable clamping device of claim 6, wherein the grips jaws are each pivotable by movement of the slide, the grip jaws are in the open position when the slide is in the retracted position and are in the closed position when the slide is in the extended position.

8. The cable clamping device of claim 6, wherein the reset mechanism includes a spring disposed between the slide and the actuating device.

9. The cable clamping device of claim 8, wherein the spring is compressed in the retracted position and applies a spring force urging the slide toward the extended position.

10. The cable clamping device of claim 9, wherein, with the handle in the first position after moving from the second position, the spring force moves the slide toward the extended position.

11. The cable clamping device of claim 10, wherein movement of the slide under the spring force moves the drive pin from the lower end of the angled slot to the upper end, moving the reset mechanism to the reset position.

12. The cable clamping device of claim 9, wherein, when the handle is pivoted from the first position toward the second position beyond the toggle axis, the spring force moves the slide toward the extended position, which rotates the handle further toward the second position and pivots the grip jaws to a first state of the closed position.

13. The cable clamping device of claim 12, wherein the actuating device urges the slide in the extended position to transfer the grip jaws from the first state of the closed position to a second state of the closed position, the grip jaws applying a tighter gripping force in the second state than in the first state.

14. The cable clamping device of claim 13, wherein, from the closed position of the grip jaws, the actuating device moves the slide toward the retracted position against the spring force.

15. The cable clamping device of claim 14, wherein movement of the slide toward the retracted position pivots the handle from the second position to the first position through the link.

16. The cable clamping device of claim 6, further comprising a housing having a first end attached to the actuating device, the handle protrudes from a second end of the housing opposite the first end.

17. The cable clamping device of claim 16, further comprising a handle retaining device providing a handle retaining force retaining the handle in the first position.

18. A processing machine, comprising:

a lower tooling holding a terminal, an end of a cable is disposed in the terminal;

an upper tooling driven to move with respect to the lower tooling to crimp the terminal onto the cable; and a cable clamping device holding the cable during crimping, the cable clamping device including a pair of grip jaws, a reset mechanism, and a handle connected to the grip jaws by the reset mechanism, the handle is pivotable about a handle pivot between a first position in which the grip jaws are in an open position and a second position in which the grip jaws are in a closed position around the cable, the reset mechanism pivots the handle from the second position to the first position before moving to a reset position of the reset mechanism that holds the handle in the first position, the handle has an angled slot at an end of the handle, the reset mechanism is connected to the handle at the angled slot.

19. The processing machine of claim 18, wherein the reset mechanism includes a slide and an actuating device connected to the slide, the slide moving between a retracted position and an extended position, the actuating device moves the slide toward the extended position to pivot the grip jaws from a first state of the closed position to a second state of the closed position, the grip jaws applying a tighter gripping force on the cable in the second state than in the first state.

* * * * *